US005092099A

United States Patent [19]

Valente

[11] Patent Number: 5,092,099

[45] Date of Patent: Mar. 3, 1992

[54] MODULAR ROOF SYSTEM

[76] Inventor: Daniel J. Valente, c/o Valente Builders, Inc., 60 Sweet Rd., Glens Falls, N.Y. 12801

[21] Appl. No.: 348,591

[22] Filed: May 8, 1989

Related U.S. Application Data

[62] Division of Ser. No. 94,299, Sep. 8, 1987, Pat. No. 4,850,174.

[51] Int. Cl.[5] ..... E04B 1/35

[52] U.S. Cl. ..... 52/745; 52/747; 52/92

[58] Field of Search ..... 52/90, 94, 93, 105, 52/70, 745, 747, 748

[56] References Cited

U.S. PATENT DOCUMENTS

| | | | |
|---|---|---|---|
| 316,859 | 4/1885 | Agee | 52/90 |
| 2,133,204 | 10/1938 | Max | 52/585 |
| 2,365,579 | 12/1944 | Mulligan | 52/90 |
| 2,541,784 | 2/1951 | Shannon | 52/90 |
| 2,724,152 | 11/1955 | Massano | 52/90 |
| 2,896,273 | 7/1959 | Petter | 52/94 |
| 3,170,266 | 2/1965 | Roberts | 52/94 |
| 3,727,354 | 4/1973 | Powell | 52/90 |
| 3,950,903 | 4/1976 | Lerch | 52/93 |
| 3,953,947 | 5/1976 | Hendrich | 52/70 |
| 4,763,783 | 8/1988 | Talbot | 52/3 |
| 4,841,690 | 6/1989 | Commins | 52/105 |

FOREIGN PATENT DOCUMENTS

| | | | |
|---|---|---|---|
| 561113 | 10/1923 | France | 52/90 |
| 1086986 | 2/1955 | France | 52/90 |
| 603574 | 9/1948 | United Kingdom | 52/90 |
| 723675 | 2/1955 | United Kingdom | 52/90 |

*Primary Examiner*—Henry E. Raduazo
*Attorney, Agent, or Firm*—Nixon & Vanderhye

[57] ABSTRACT

Roofs for houses are primarily constructed off site, are disassembled and transported to the house construction site, and then reassembled, lifted onto the house shell, and nailed or otherwise affixed in place. Each roof section comprises one or more roof panels, ceiling joists, and upright supports. The roof panels include subroofing, roofing, and first joists extending along the slope of the roof, with facia and all other necessary elements to complete a roof provided. The ceiling joists have openings at both ends, and the upright supports have openings at one end with the other end beveled to engage a first joist. Dowels, which have a tapered end for ease of insertion, pin the ceiling joists to the first joist of the roof panel, and the upright supports. Sheet material, such as plywood, splices the upright supports to the first joists. Two roof sections are connected together at their apex by a ventable ridge.

16 Claims, 4 Drawing Sheets

MODULAR ROOF SYSTEM

This is a division of application Ser. No. 07/094,299, filed Sept. 8, 1987, now U.S. Pat. No. 4,850,174.

BACKGROUND AND SUMMARY OF THE INVENTION

In housing construction, and in particular the construction of custom and track single family dwellings, the most time consuming, difficult, and dangerous part of the construction procedure can be the construction of the roof. However the construction of the roof is also one of the most important since getting the house, during construction, "under roof" allows contractors to work when weather conditions might otherwise prevent it. In a typical single family house construction, the roof takes many days to complete even when the labor is skilled, poses a safety hazard to workers who must work on the roof (e.g. putting on roofing material, etc.), and the constant passage over the roof that is necessary during construction has a tendency to do some damage to the roof which ultimately can decrease its effective life.

According to the present invention, it is possible to practically prefabricate a roof, ship it over conventional highways in trucks, reassemble it on the house site, and lift it into place and affix it in that position. A roof section can be safely constructed from the disassembled components on the housing site in a very short period of time, and can be lifted into place and nailed in proper position—also in a very short period of time. In this way hundreds of man hours can be saved in the roof construction at the job site, and the house can brought "under roof" much more quickly, with resulting advantages in being able to continue construction even when weather conditions might otherwise ordinarily prevent it.

According to one aspect of the present invention, a method of erecting a roof on a shell for a house is provided. The method comprises the steps of: (a) Constructing at a location remote from the house a roof panel comprising subroofing, roofing, and first joists extending along the proposed slope of the roof panel. (b) Constructing a plurality of ceiling joists and a plurality of upright supports. (c) Constructing a roof section remote from the house by pinning the ceiling joists to the first joists and the upright supports, and bringing the upright supports into supporting contact with the first joists, to construct a generally triangular support structure. (d) Lifting the roof section onto the top of a house. And, (e) permanently affixing (e1) all of the elements of the roof section together and (e2) to the house shell.

Step (e) is preferably further practiced by disposing braces extending transversely to the ceiling joists and to the upright supports, and affixing the braces to the ceiling joists and upright supports, and step (el) is practiced before step (d). Step (c) is preferably further practiced by disposing the portions of the upright supports and first joists in contact with each other between sheet material (e.g. plywood) splices, and attaching the sheet material (as by air nailing) to both the upright supports and the first joists.

Typically step (c) is practiced at a manufacturing location, and the method comprises the further steps of, between steps (c) and (d): (c1) Unpinning the ceiling joists from the first joists and upright supports, and removing the upright supports from contact with the first joists. (c2) Shipping the panel, ceiling joists, and upright supports in disassembled relationship by truck to the house site. And, (c3) repeating step (c) at the house site. The components are preferably labelled when assembled at the factory location so that after they are disassembled they may be easily reassembled in the proper positions, and the roof panel may be wrapped in plastic to protect it.

The invention also relates to a prefabricated roof panel, and a prefabricated roof section. An exemplary roof panel according to the invention comprises: subroofing; roofing; a plurality of first joists extending along the slope that the roof panel will assume in use; a plurality of second joists generally transverse to the first joists and facia applied on one of the second joists; and means defining openings in the first joists adjacent the facia, the openings being generally in alignment with each other from joist to joist, and for receiving pins.

An exemplary roof section according to the invention has as the major component parts a roof panel, ceiling joists, and upright supports, with dowels (preferably tapered at one end) for pinning the ceiling joists to the first joists of the roof panel and the upright supports. The ends of the upright supports engaging the first joists are beveled for that purpose, and plywood, or other sheet material, splices are provided at the second ends of the upright supports, retaining first joists between them. The joists and supports preferably are wooden, as are the dowels. Indicia is preferably applied to the components to indicate where parts fit back together for easy assembly.

It is the primary object of the present invention to provide for the quicker, sturdier, safer, and more predictable erection of roofs for houses. This and other objects of the invention will become clear from an inspection of the detailed description of the invention, and from the appended claims.

DETAILED DESCRIPTION OF THE DRAWINGS

Figure 1:
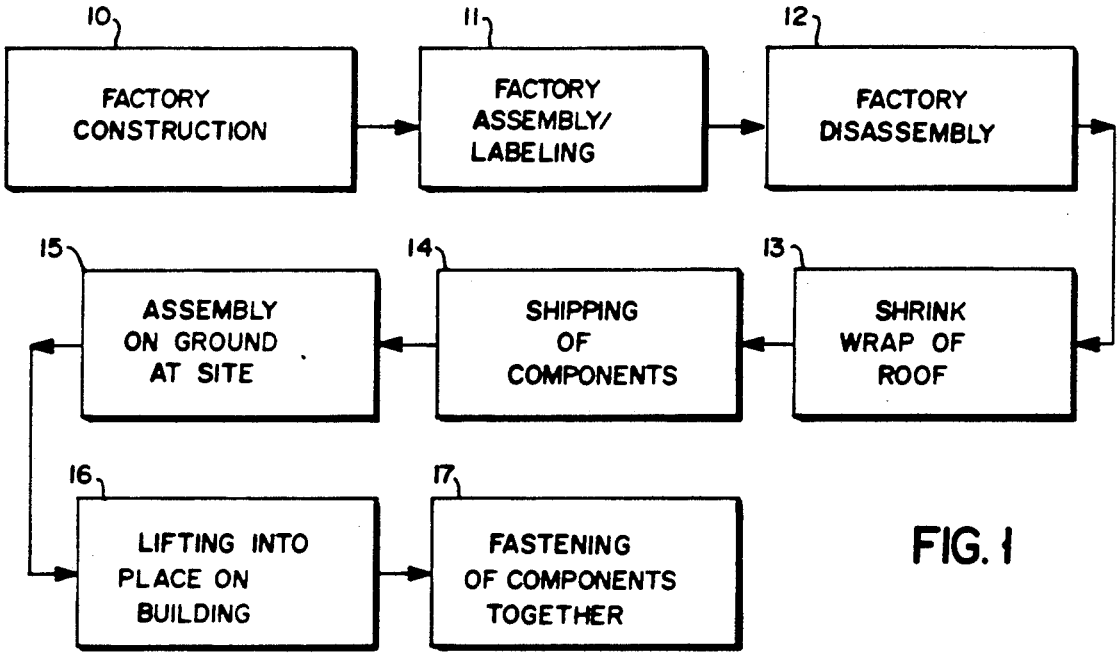
FIG. 1 is a schematic view illustrating the sequence of method steps that may be practiced according to the present invention.

FIG. 1 illustrates the basic sequence of steps that may be performed in the practice of the invention. In step 10, a roof section is constructed at a factory site. In step 11, the roof section is assembled together, and the components are labelled for easy reassembly. At step 12, the components are disassembled. At step 13 the roof panel or panels are shrink-wrapped with plastic to protect the roofing material. In step 14 the disassembled components are shipped by truck to the housing site. All the components are dimensioned so that when disassembled they may be readily transported by conventional trucks over highways. In step 15 the components are reassembled on the ground at the housing site. They may be nailed together on the ground. In step 16 the prefabricated roof section is lifted onto the house shell with a crane; and in step 17 the roof section components are nailed to the house shell.

Figure 2:
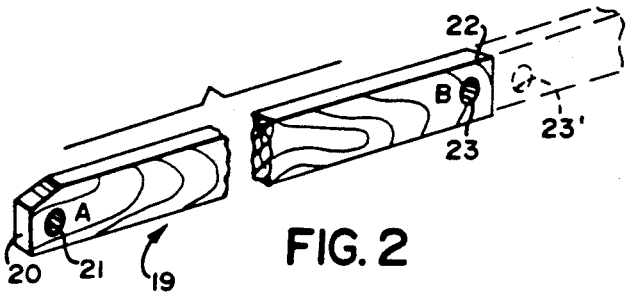
FIG. 2 is a perspective view of an exemplary ceiling joist according to the invention.

FIG. 2 illustrates a ceiling joist 19, which is one of the major components of the prefabricated roof section according to the invention. The ceiling joist 19 is preferably made of wood and has a first end 20 thereof with a beveled corner to interfit with the slope of the roofing material, and an opening 21 formed adjacent to the first end 20. It also has a second end 22 thereof with an opening 23 adjacent that second end. Note that indicia A and B are provided on the joist 19, as an indication that labelling is preferably provided in order to allow easy reassembly of components. The exact labelling or indicia utilized is not significant, and labelling system that makes sense being utilizable.

Alternatively, as indicated in dotted line in FIG. 2, the ceiling joist 19 may be constructed so that it spans two roofing sections.

Figure 3:
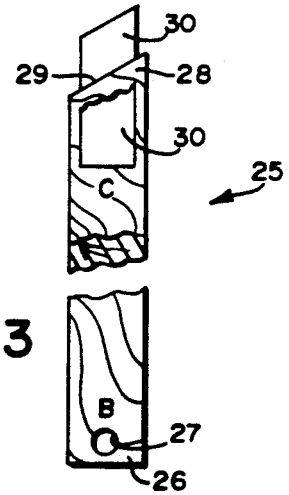
FIG. 3 is a side view of an exemplary upright support according to the invention.

FIG. 3 illustrates another significant component of the prefabricated roof section according to the invention, one of the upright supports 25. The upright support 25 preferably is of wood and has a first end 26 with an opening 27 formed therein. The second end 28 is preferably beveled as indicated at 29, so as to interfit with the roof panel as will be further described. Preferably sheet material splices, such as plywood sheets 30, are glued or otherwise attached to the upright 25 adjacent second end 28, extending past the second end 28. Note the labelling B, C provided on the upright 25.

Figure 4:
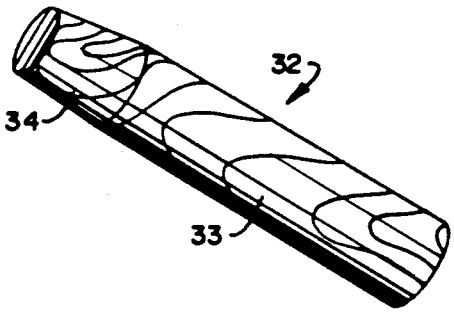
FIG. 4 is a perspective view of an exemplary tapered end wooden dowel according to the invention.

FIG. 4 illustrates a wooden dowel 32, having a body 33 and at least one tapered end 34, which is utilized for pinning various components together. The dowel 32 typically would have a diameter of about one inch, and would be dimensioned to fit within the openings 21, 23, 27 yet would be removable therefrom. While wood is a preferred material, other materials, such as metal or plastic, could be utilized.

Figure 5:
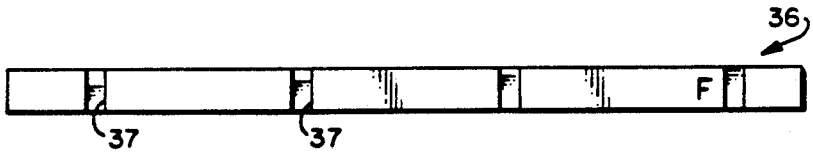
FIGS. 5 and 6 are top plan and side views, respectively, of an exemplary brace according to the present invention.
Figure 6:
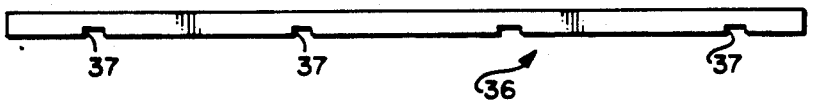

FIGS. 5 and 6 illustrate a brace 36 having notches 37 formed therein which is utilized to connect a plurality of upright supports 25 together, and brace them, or to connect a plurality of ceiling joists 19. The upright supports 25 or ceiling joists 19 are received within the grooves 37. The braces 36 preferably also are of wood, and have labelling as indicated by letter F in FIG. 5.

Figure 7:
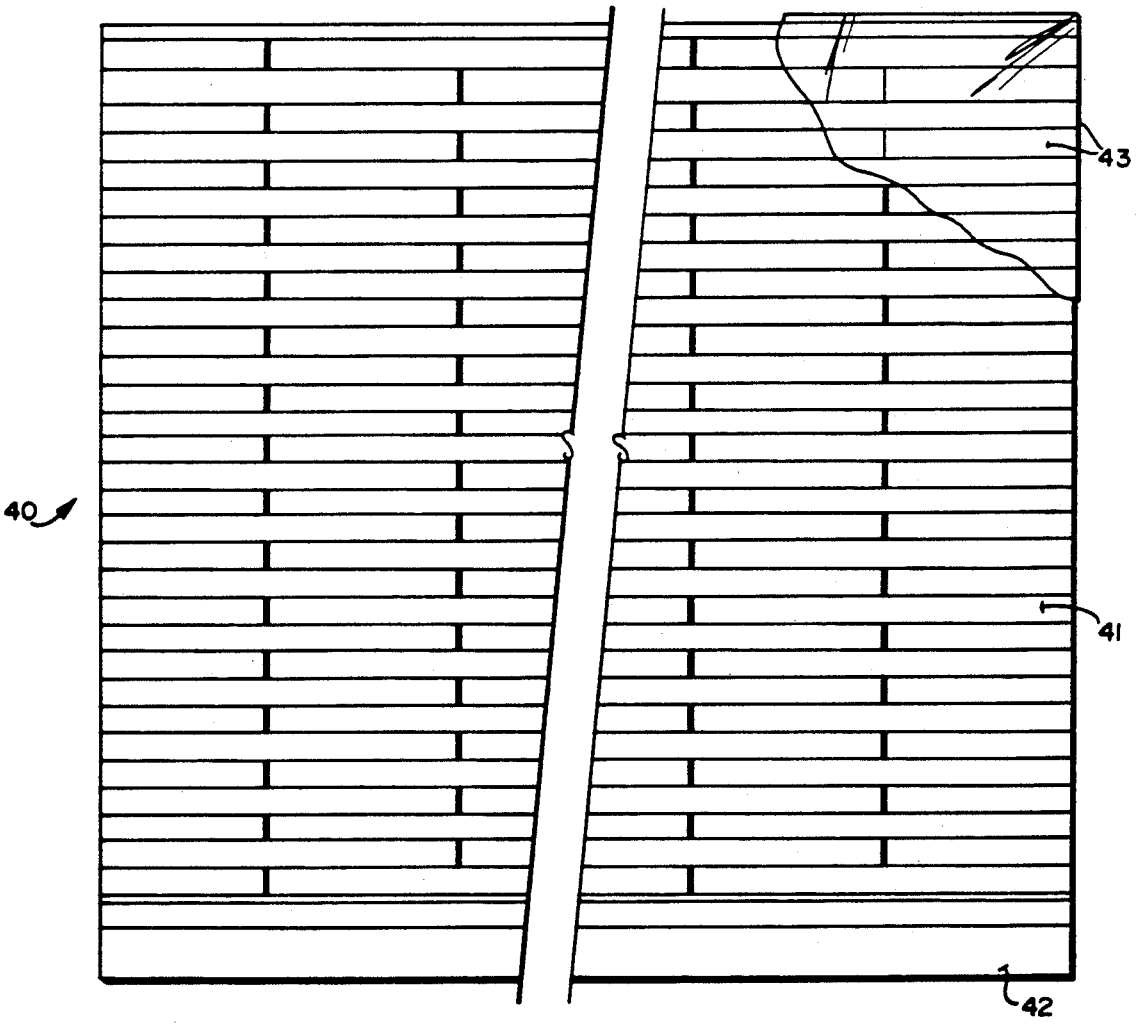
FIG. 7 is a side view of an exemplary roof panel according to the present invention, looking in on the roofing material.

FIG. 7 illustrates one side of a roof section according to the invention, only the roof panel 40 being visible. The panel 40 includes roofing 41 (such as shingles), and facia 42, and all other components necessary to provide a finished roof. 43 illustrates shrink-wrap plastic, which may be applied to the entire roofing panel 40 (or just over shingles 41) to protect it during transportation, and then removed on site either prior to assembly into the final roof section, or partially prior to assembly and the rest after completion. The panel 40 is dimensioned to be transportable by truck over conventional highways.

Figure 8:
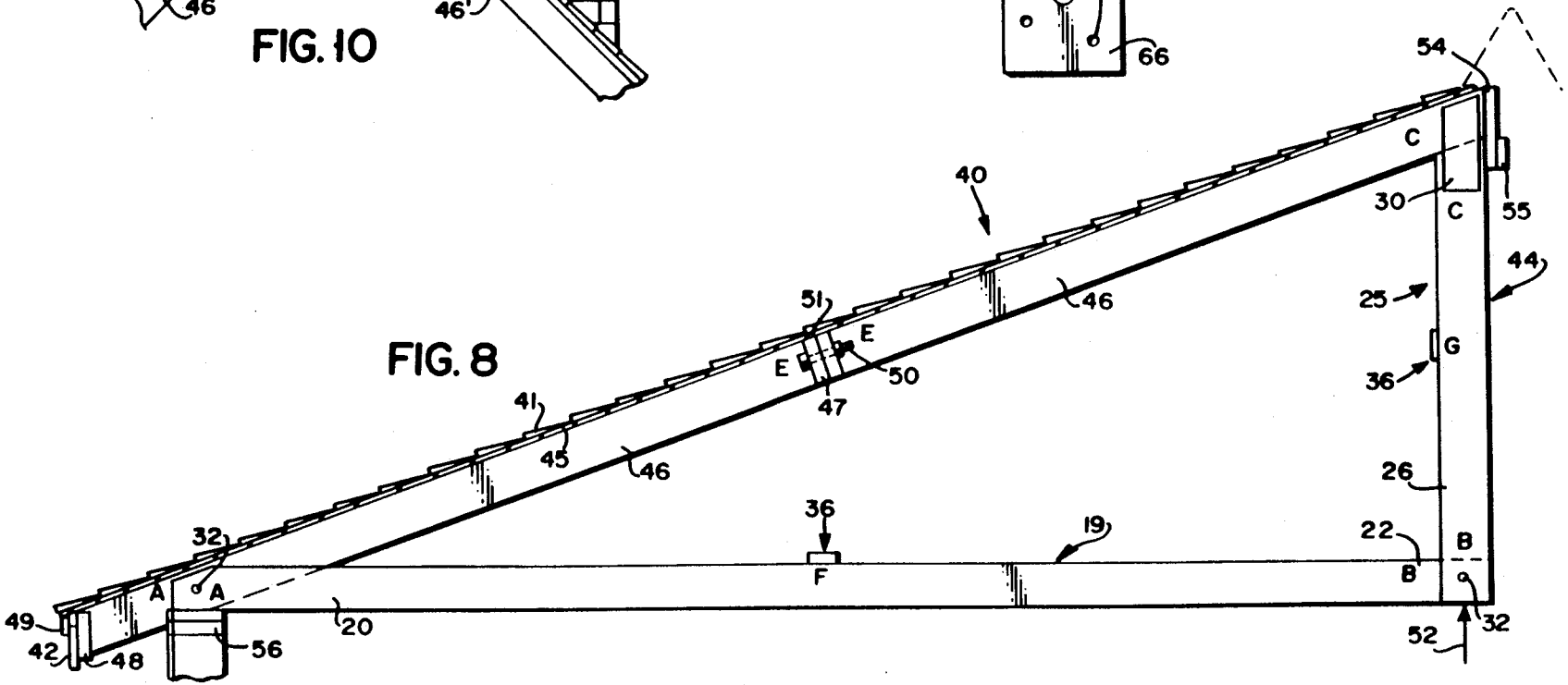
FIG. 8 is an end view of an exemplary roof section according to the invention including a roof panel, ceiling joists, and upright supports, connected at one portion thereof to a stud wall.
Figure 9:
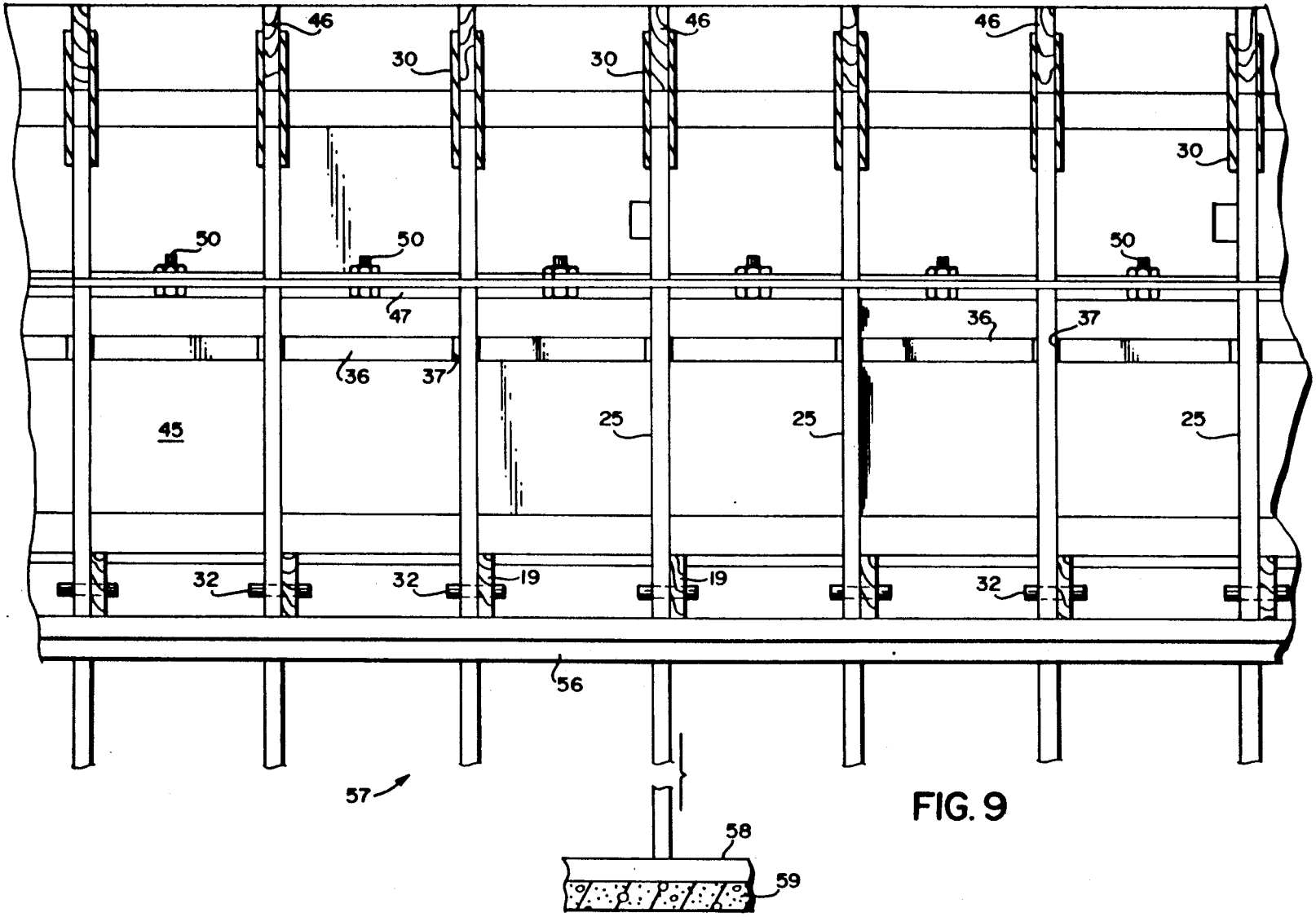
FIG. 9 is a side view of the roof section of FIG. 8 looking in at the side opposite that illustrated in FIG. 7, and showing the stud wall in more detail.

FIGS. 8 and 9 most clearly illustrate the manner in which the components heretofore described are assembled to make a roof section 44, and how the roof section 44 is attached to the house shell. Note that from these FIGURES it will be seen that the roof panels 40 also include subroofing 45, which typically would be plywood or like fibrous material. While sheet metal could be employed, it is neither necessary nor desirable. A plurality of parallel first joists 46 which extend generally along the slope of the roof panel (when in use as a roof) are provided, as are second joists 47 generally transverse to the first joists 46, and which may be utilized to interconnect roof panels together in a roof section. Second joists 48 provide the backing for the facia 42 and the flashing 49 (or any other finishing components). Note the labelling on the first joists 46, too.

FIG. 8 clearly illustrates how the various components are connected together into a generally triangular support structure. After the individual components are constructed, and in this case two different roof panels are connected end to end by joining second joists 47 thereof with bolts 50, the ceiling joists 19 are pinned at one end thereof by dowels 32 to first joists 46 adjacent facia 42 (the dowels 32 being received in openings formed in the joists 46, which openings are not seen in FIG. 8), and the ceiling joists 19 are pinned at second portions thereof, such as at end 22 thereof, with dowels 32 to the first ends 26 of the upright supports 25. The first joists 46 are also received between the plywood splices 30 of the upright supports 25, with the beveled ends 29 of the upright supports 25 conforming to the slope of the first joists 46 for the particular pitch of roof involved. Note that the assembled roof panel preferably has roofing 51 (applied at the construction site) that specifically covers the joint between the roof panels at second joist 47, and that spacer blocks 54, 55 are provided at the upwardmost end of the joist 46 to facilitate connection to the upright supports 25 and to provide spacing for ventilation, particularly when a ventable ridge is utilized.

After the components just described are assembled together on the ground at the construction site they are fixed together by air-nailing or the like, and then they are lifted by a crane up onto the house shell. For example using a nail gun, one air nails the ceiling joists 19 to the cross portions 56, first joists 46, and upright supports 25, and nails the plywood splices 30 to the first joists 46. Then the braces 36 are put in place and nailed to the joists 19 to brace them, and to the upright supports 25 to brace them. In FIGS. 8 and 9 they are shown on the house shell, the ceiling joists 19 engaging the top cross portions 56 of the stud wall 57. Additional support, either permanent or temporary, may be provided at point 52 (see FIG. 8), or in some circumstances the ceiling joists 19 are long enough to extend completely across to an opposite stud wall. FIG. 9 illustrates a particular manner in which the stud wall 57 is constructed, in which bottom cross pieces 58 of the stud wall are supported on concrete slab 59 or the like. Any desirable type of framing or shell construction may be utilized for supporting the prefabricated roof sections according to the invention.

Once the roof section 44 has been lifted onto the house frame as illustrated in FIG. 8, all of the components are then permanently affixed to the shell (e.g. stud wall 55). The brackets of FIG. 11 may be used for this purpose. If desired, the roof section—after initial assembly—can be lifted into place first before air nailing of the components together (and to the stud wall).

Figure 10:
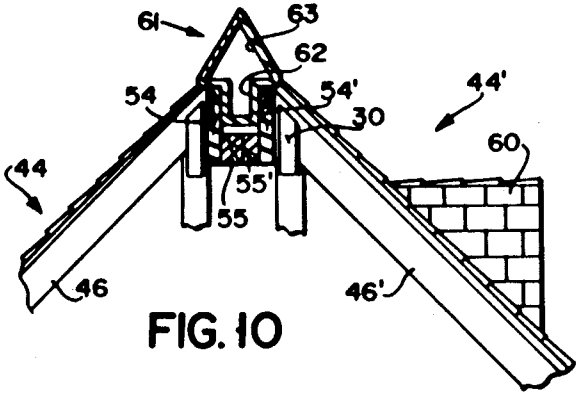
FIG. 10 is an end detail view showing the interconnection of a pair of roof sections to form a house roof.

After the first roof section 44, as illustrated in FIGS. 8 and 9, is put in place, then the on site manufacturing steps are repeated and a second roof section is put into place. The roof sections 40, 40' as illustrated in FIG. 10 are then connected together at the spacer blocks 55, 55'. Note that the roof sections 44, 44' may have different pitches, and may be of different construction; for example a dormer 60 may be provided in the roof section 60' roof panel. Ultimately, some sort of ridge 61 is provided between the two sections 44, 44'. In the preferred embodiment illustrated in FIG. 10, the ridge 61 is a ventable ridge, or "ridge vent" such as that sold by Browning Metal Products Company. A ridge vent has a first channel shaped portion 62 disposed between the blocks 54, 54', and has a pointed top portion 63. The ridge 61 is constructed so as to provide adequate ventilation in the roof and attic area.

Figure 11:
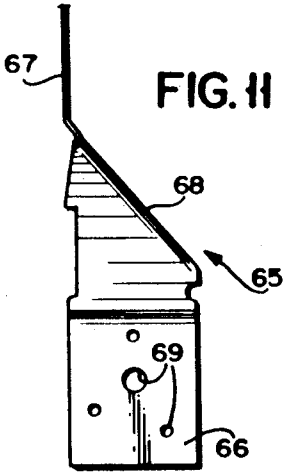
FIG. 11 is a side view of an exemplary bracket that may be utilized in construction to connect components that are 90° with respect to each other.

FIG. 11 illustrates metal brackets 65 that may be utilized at various points of the construction during permanent affixing of the components together, particularly for fixing the roof section 44 to the stud wall 57. Wherever it is desired in the final affixing of the components together to join two components that are transverse to each other, the bracket 65 can be used. The bracket has faces or tabs 66, 67 which are perpendicular to each other, a twisted joining portion 68, and means defining openings 69 in the tab 66, 67 for receipt of fasteners such as screws or nails.

In those situations where the entire roof can be assembled at one time, and the ceiling joists 19 span the total extent of two roof sections, the entire prefabricated roof itself may be lifted into place before the components are affixed together.

Particularly in the construction of custom houses, it will be necessary in order to ensure proper fit of the components and stability of the roof to actually assemble the entire roof together at the factory site. The dowels 32 particularly facilitate the assembly and reassembly of the components, as do the splices 30. Under some circumstances dowels 32 could be substituted for splices 30, or vice-versa. However, where a large number of houses having the same roof construction are to be manufactured, once manufacture of the components is standardized it may not be necessary to assemble each roof section at the factory site, but rather the components may merely be shipped to the construction site and assembled there.

Especially where the roof pitch is steep, optional braces 71 may be utilized (shown in dotted line in FIG. 8). If used, such braces 71 would typically be fewer in number than upright supports 25, would be pinned with a dowel at an end 72 to a ceiling joist 19, and notched at an end 73 to receive second joists 47. The ends may be labeled, as well as the joists 19, 47 with which they are associated.

While the invention has been described in terms of the construction of "houses", it is understood that it is equally applicable to townhouses and other buildings having non-flat roofs, and the term "house" in the specification and claims should be interpreted broadly.

It will thus be seen that according to the present invention a simple, practical, and effective method and structures have been provided for the construction of roofs for houses. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A prefabricated roof section assembly, adapted to have a slope when in use as a roof, comprising:

at least one roof panel comprising subroofing, roofing, and a plurality of first joists extending along the slope of the roof panel when in use as a roof, and means defining a plurality of generally in-line openings in said first joists adjacent a first end of each;

a plurality of ceiling joists having first and second ends with means defining openings in said first and second ends;

a plurality of upright supports having first and second ends with means defining openings in said first ends;

connection means for connecting said first joists and said upright supports together, and;

a plurality smooth surfaced, headless, non-locking dowels dimensioned to fit in said ceiling joist, first joist, and upright support openings to pin said ceiling joists to said first joists and said upright supports.

2. A prefabricated roof section as recited in claim 1 wherein each of said dowels has a tapered end for ease of insertion into said openings and to facilitate alignment of the components pinned thereby.

3. A prefabricated roof section as recited in claim 1 further comprising a dormer in said roof panel.

4. A prefabricated roof section as recited in claim 1 further comprising indicia disposed adjacent said first and second ends of said ceiling joists, and cooperating indicia disposed adjacent the first ends of said first joists and the first ends of said upright supports, for facilitating assembly of the roof section together.

5. A prefabricated roof section as recited in claim 1 wherein said ceiling joists, upright supports, and first joists are wooden.

6. A roof section as recited in claim 2 wherein said sheet material splicing is plywood.

7. A prefabricated roof section as recited in claim 1 wherein said roof panel further comprises at least one second joist generally transverse to said first joists, including one of said second joists adjacent the first end of said first joists and for mounting facia thereon.

8. A prefabricated roof section as recited in claim 1 wherein said roof panel comprises a plurality of roof panels connected together, each roof panel having a second joist generally transverse to said first joist, and said second joists connected together by fasteners.

9. A prefabricated roof section as recited in claim 8 wherein each of said roof panels has a length and width such that it may be transported by truck over conventional highways.

10. A method of erecting a permanent roof having a proposed slope on a shell for a house comprising the steps of:

(a) constructing, at a location remote from the house, a roof panel comprising subroofing, roofing, and first joists extending along the proposed slope of the roof panel;

(b) constructing a plurality of ceiling joists and a plurality of upright supports;

(c) constructing a roof section remote from said house by pinning the ceiling joists to said first joists and said upright supports, and by bringing said upright supports into supporting contact with said first joists, to construct a generally triangular support structure, by insertion of smooth surfaced, headless, non-locking dowels, tapered at one end for ease of insertion, into openings aligned in said ceiling joists, and said first joists and upright supports, respectively;

(d) permanently affixing all of the elements of the roof section together, including by placing braces extending transverse to said ceiling joists into contact with a plurality of ceiling joists and affixing the braces and ceiling joists together, and disposing braces extending transverse to said upright supports into contact with a plurality of said upright supports, and affixing the braces and upright supports together;

(e) lifting the roof section onto the top of a house shell; and (f) affixing the elements of the roof section to the house shell.

11. A method as recited in claim 10 wherein the roof panel includes second joists generally transverse to the first joists, and wherein step (a) is practiced by joining together the second joists of two different smaller roof panels to produce a larger roof panel with the first joists of the panels parallel to each other.

12. A prefabricated roof section assembly, adapted to have a slope when in use as a roof comprising:

at least one roof panel comprising subroofing, roofing, and a plurality of first joists extending along the slope of the roof panel when in use as a roof, and means defining a plurality of generally in-line openings in said first joists adjacent a first end of each;

a plurality of ceiling joists having first and second ends with means defining openings in said first and second ends;

a plurality of upright supports having first and second ends with means defining openings in said first ends; and a plurality of dowels dimensioned to fit in the ceiling joist, first joist, an upright support opening to pin the ceiling joist to the first joist and the upright supports; and wherein said connecting means includes sheet material splices connected to said upright supports and straddling said upright supports at said second end thereof, each pair of said splices spaced apart at distance sufficient to receive the first joist therebetween for facilitating connection of said upright supports to said first joist.

13. A prefabricated roof section assembly, adapted to have a slope when in use as a roof comprising:

at least one roof panel comprising subroofing, roofing, and a plurality of first joists extending along the slope of the roof panel when in use as a roof, and means defining a plurality of generally in-line openings in said first joists adjacent a first end of each;

a plurality of ceiling joists having first and second ends with means defining openings in said first and second ends;

a plurality of upright supports having first and second ends with means defining openings in said first ends;

a plurality of dowels dimensioned to fit into said ceiling joist, first joist, and upright support openings to pin said ceiling joist to said first joist and said upright supports; and wherein said upright supports have second ends that are beveled so as to be adapted to engage and support said first joists, being beveled at an angle generally equal to the roof pitch.

14. A method of erecting a permanent roof having a proposed slope on a shell for a house comprising the steps of:

(a) constructing, at a location remote from the house, a roof panel comprising subroofing, roofing, and first joists extending along the proposed slope of the roof panel;

(b) constructing a plurality of ceiling joists and a plurality of upright supports;

(c) constructing a roof section remote from said house by pinning the ceiling joists to said first joists and said upright supports, and by bringing said upright supports into supporting contact with said first joists, to construct a generally triangular support structure, by disposing cooperating portions of said upright support and said first joists in contact with each other between sheet material splices, and attaching the sheet material to both the upright supports and the first joists;

(d) permanently affixing all of the elements of the roof section together, including by placing braces extending transverse to said ceiling joists into contact with a plurality of ceiling joists and affixing the braces and ceiling joists together, and disposing braces extending transverse to said upright supports into contact with a plurality of said upright supports, and affixing the braces and upright supports together;

(e) lifting the roof section onto the top of a house shell; and (f) affixing the elements of the roof section to the house shell.

15. A method of erecting a permanent roof having a proposed slope on a shell for a house comprising the steps of:

(a) constructing, at a location remote from the house, a roof panel comprising subroofing, roofing, and first joists extending along the proposed slope of the roof panel;

(b) constructing a plurality of ceiling joists and a plurality of upright supports;

(c) constructing a roof section remote from said house by pinning the ceiling joists to said first joists and said upright supports, and by bringing said upright supports into supporting contact with said first joists, to construct a generally triangular support structure;

(d) permanently affixing all of the elements of the roof section together, including by placing braces extending transverse to said ceiling joists into contact with a plurality of ceiling joists and affixing the braces and ceiling joists together, and disposing braces extending transverse to said upright supports into contact with a plurality of said upright supports, and affixing the braces and upright supports together;

(e) lifting the roof section onto the top of a house shell;

(f) affixing the elements of the roof section to the house shell;

and wherein step (c) is practice at a manufacturing location, and comprising the further steps of, between steps (c) and (d):

(c1) unpinning the ceiling joists from the first joists and upright supports, and removing said upright supports from contact with said first joists; (c) shipping the panel, ceiling joists, and upright supports in disassembled relationship by truck to the house site; and (c3) repeating step (c) at the house site.

16. A method as recited in claim 15 comprising the further step of labelling the first joists, ceiling joists, and upright supports at the manufacturing location to indicate the inter-connection therebetween, so that when the ceiling joists, first joists, and upright supports are reassembled at the house site reassembly is simplified.

* * * * *